United States Patent [19]

Newcomb

[11] 4,358,384

[45] Nov. 9, 1982

[54] COMPOSITE GREASE FOR ROCK BIT BEARINGS

[75] Inventor: Alan L. Newcomb, Rancho Palos Verdes, Calif.

[73] Assignee: Smith International Inc., Newport Beach, Calif.

[21] Appl. No.: 194,587

[22] Filed: Oct. 6, 1980

[51] Int. Cl.[3] ..... C10M 5/14

[52] U.S. Cl. ..... 252/19; 175/227; 175/228; 308/8.2

[58] Field of Search ..... 252/19; 175/227, 228; 308/8.2

[56] References Cited

U.S. PATENT DOCUMENTS

| | | | |
|---|---|---|---|
| 2,543,741 | 2/1951 | Zweifel | 252/19 X |
| 2,754,266 | 7/1956 | Stegemeier et al. | 252/19 |
| 3,063,941 | 11/1962 | Wilson | 252/19 X |
| 3,423,315 | 1/1969 | McCarthy et al. | 252/19 |
| 3,652,414 | 3/1972 | Bergeron | 252/19 |
| 3,784,264 | 1/1974 | Jackson | 308/8.2 |
| 3,801,506 | 4/1974 | Cross | 252/40 |
| 3,935,114 | 1/1976 | Donaho | 252/18 |
| 4,155,860 | 5/1979 | Soucy | 252/26 |

FOREIGN PATENT DOCUMENTS

| | | | |
|---|---|---|---|
| 710613 | 6/1954 | United Kingdom | 252/19 |
| 658165 | 12/1976 | U.S.S.R. | 252/19 |

OTHER PUBLICATIONS

One Sheet of a Publication by Co-Mar Incorporated.

*Primary Examiner*—Andrew Metz

*Attorney, Agent, or Firm*—Christie, Parker & Hale

[57] ABSTRACT

A rock bit for drilling subterranean formations is lubricated with a grease composition comprising molybdenum disulfide particles in the range of from 6 to 14% by weight, copper particles in the range of from 3 to 9% by weight, a metal soap thickener in the range of from 4 to 10% by weight, and a balance of primarily hydrocarbon oil.

40 Claims, 2 Drawing Figures

COMPOSITE GREASE FOR ROCK BIT BEARINGS

FIELD OF THE INVENTION

Figure 2:
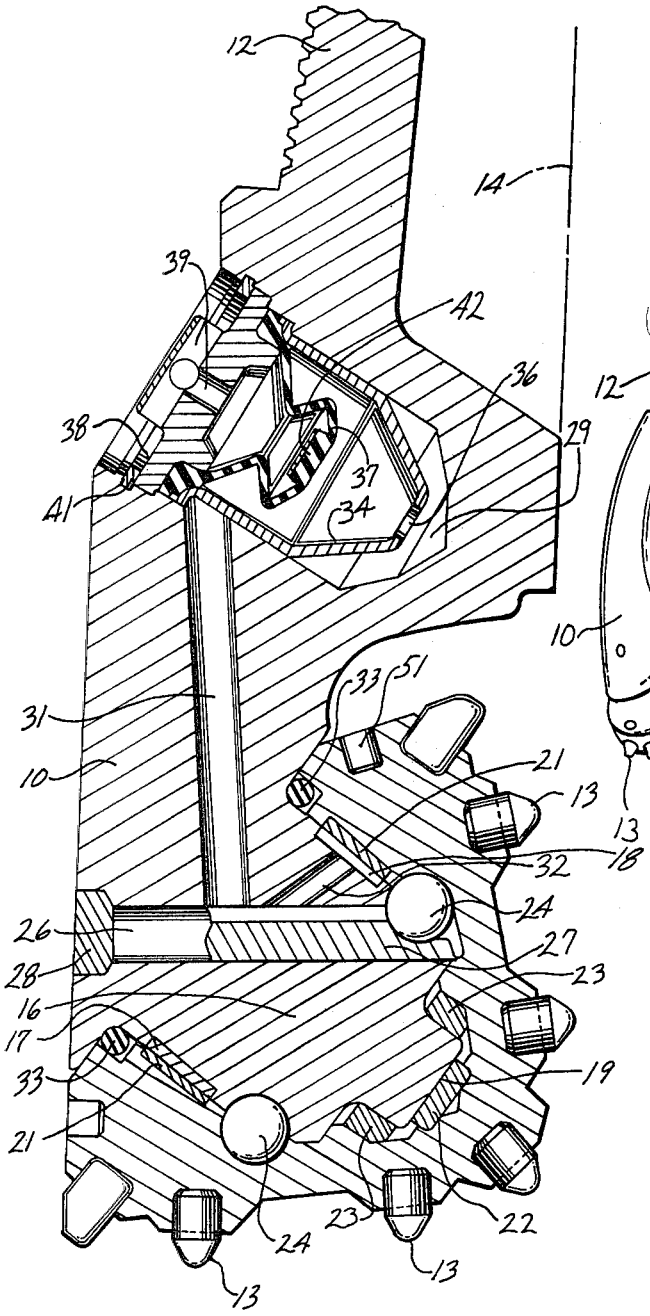

This invention relates to a grease containing molybdenum disulfide and copper particles for lubricating journal bearings in a rock bit for drilling oil wells or the like.

BACKGROUND

Heavy duty rock bits are employed for drilling wells in subterranean formations for oil, gas, geothermal steam and the like. Such bits have a body connected to a drill string and a plurality, typically three, of hollow cutter cones mounted on the body for drilling rock formations. The cutter cones are mounted on steel journals or pins integral with the body at its lower end. In use the drill string and bit body are rotated in the bore hole and each cone is caused to rotate on its respective journal as the cone contacts the bottom of the bore hole being drilled. As such a rock bit is used in hard, tough formations, high pressures and temperatures are encountered. The total useful life of a rock bit in such severe environments is in the order of 20 to 200 hours for bits in sizes of about 6½ to 12¼ inch diameter at depths of about 5000 to 20,000 feet. Useful lifetimes of about 65 to 150 hours are typical.

When a rock bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the lifetime of a drill bit in a rock formation. Prolonging the time of drilling minimizes the lost time in "round tripping" the drill string for replacing bits.

Replacement of a drill bit can be required for a number of reasons, including wearing out or breakage of the structure contacting the rock formation. One reason for replacing the rock bits includes failure or severe wear of the journal bearings on which the cutter cones are mounted. These bearings are subject to very high pressure drilling loads, high hydrostatic pressures in the hole being drilled, and high temperatures due to drilling as well as elevated temperatures in the formation being drilled. Considerable development work has been conducted over the years to produce bearing structures and employ materials that minimize wear and failure of such bearings.

The journal bearings are lubricated with grease adapted to such severe conditions. Such lubricants are a critical element in the life of a rock bit. A successful grease should have a useful life longer than other elements of the rock bit so that premature failures of bearings do not unduly limit drilling. Failure of lubrication can be detected by generation of elevated pressure in the bit, evidence of which can often be found upon examination of a used bit. The high pressure is generated due to decomposition of oil in the grease with consequent generation of gas when lubrication is deficient and a bearing overheats due to friction. Lubrication failure can be attributed to misfit of bearings, or seal failure as well as problems with a grease.

Pressure and temperature conditions in a rock bit can vary with the time as the rock bit is used. For example, when a "joint" of pipe is added to the drill string, weight on the bit can be relieved and slight flexing can occur. Such variations can result in "pumping" of the grease through seals, leading to loss of grease or introduction of foreign materials such as drilling mud that can damage bearing surfaces.

It is therefore desirable to provide a grease for lubricating rock bits that has a long useful life, does not generate substantial internal pressure in the bit and protects metal bearing surfaces from premature wear or failure.

BRIEF SUMMARY OF THE INVENTION

There is, therefore, provided in practice of this invention according to a presently preferred embodiment a grease composition for lubricating a rock bit comprising molybdenum disulfide particles in the range of from 6 to 14% by weight, copper particles in the range of from 3 to 9% by weight, a thickener including a soap of a metal selected from the group consisting of aluminum, barium, calcium, lithium, sodium, and strontium, and a balance of primarily hydrocarbon oil.

DRAWINGS

Figure 1:
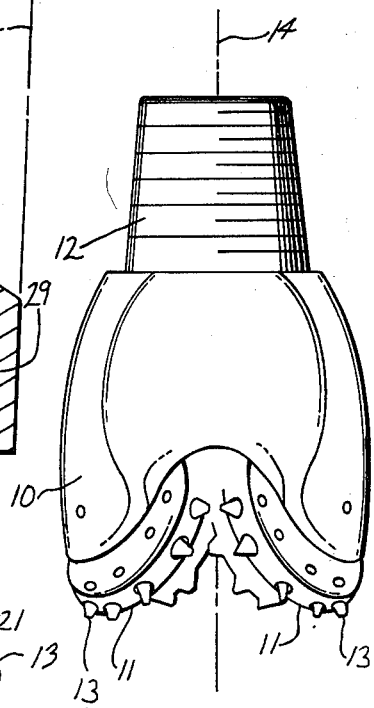

A rock bit lubricated with such a grease composition is illustrated in semi-schematic perspective in FIG. 1 and in a partial cross section in FIG. 2.

DESCRIPTION

A rock bit employing a grease composition containing particles of molybdenum disulfide and copper comprises a body 10 having three cutter cones 11 mounted on its lower end. A threaded pin 12 is at the upper end of the body for assembly of the rock bit onto a drill string for drilling oil wells or the like. A plurality of tungsten carbide inserts 13 are provided in the surfaces of the cutter cones for bearing on rock formation being drilled.

FIG. 2 is a fragmentary longitudinal cross section of the rock bit extending radially from the rotational axis 14 of the rock bit through one of the three legs on which the cutter cones 11 are mounted. Each leg includes a journal pin 16 extending downwardly and radially inwardly of the rock bit body. The journal pin includes a cylindrical bearing surface having a hard metal insert 17 on a lower portion of the journal pin. The hard metal insert is typically a cobalt or iron base alloy welded in place in a groove on the journal leg and having a substantially greater hardness than the steel forming the journal pin and rock bit body. An open groove 18 corresponding to the insert 17 is provided on the upper portion of the journal pin. Such a groove can, for example, extend around 60% or so of the circumference of the journal pin and the hard metal 17 can extend around the remaining 40% or so. The journal pin also has a cylindrical nose 19 at its lower end.

Each cutter cone 11 is in the form of a hollow generally conical steel body having tungsten carbide inserts 13 pressed into holes on the external surface. Such tungsten carbide inserts provide the drilling action by engaging a subterranean rock formation as the rock bit is rotated. The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19, and carries the principal thrust loads of the cone on the journal pin. A bushing 23 surrounds the nose and provides additional bearing surface between the cone and journal pin.

A plurality of bearing balls 24 are fitted into complementary ball races in the cone and on the journal pin. These balls are inserted through a ball passage 26 which extends through the journal pin between the bearing races and the exterior of the rock bit. A cone is first fitted on the journal pin and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and cone are lubricated by a grease composition as provided in practice of this invention. Preferably the interior of the rock bit is evacuated and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body which is connected to the ball passage 26 by a lubricant passage 31. Grease also fills the portion of the ball passage adjacent the ball retainer, the open groove 18 on the upper side of the journal pin and a diagonally extending passage 32 therebetween. Grease is retained in the bearing structure by a resilient seal in the form of an O-ring 33 between the cone and journal pin.

A pressure compensation subassembly is included in the grease reservoir 29. This subassembly comprises a metal cup 34 with an opening 36 at its inner end. A flexible rubber bellows 37 extends into the cup from its outer end. The bellows is held in place by a cap 38 having a vent passage 39 therethrough. The pressure compensation subassembly is held in the grease reservoir by a snap ring 41.

When the rock bit is filled with grease, the bearings, the groove 18 on the journal pin, passages in the journal pin, the lubrication passage 31 and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the O-ring 33 and permit drilling mud or the like to enter the bearings. Such material is abrasive and can quickly damage the bearings. Conversely, if the grease volume should contract, the bellows can expand to prevent low pressures in the sealed grease system, which would cause flow of abrasive and/or corrosive substances past the O-ring seal 33.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure relief check valve can also be provided in the grease reservoir for relieving over-pressures in the grease system that could damage the seal 33.

A variety of grease compositions have been employed in such rock bits. Such grease compositions typically comprise a high viscosity, refined petroleum or hydrocarbon oil which provides the basic lubricity of the composition and may constitute about $\frac{3}{4}$ of the total grease composition. Such mineral oil is thickened with a conventional metal soap or metal complex soap wherein the metal is aluminum, barium, calcium, lithium, sodium, or strontium. Solid additives have been suggested because of the extremely high pressures in the bearing surfaces during drilling. A variety of conventional solid additives are available, such as copper, lead, molybdenum disulfide, graphite, and the like. Prior greases used in rock bits have included lead, molybdenum disulfide or a special copper powder with lead dispersed as a discontinuous second phase in the copper matrix. So far as is known, combinations of solid additives as taught in this invention have not been heretofore proposed. Such grease compositions can also include conventional fillers, thickeners, thixotropic agents, extreme pressure additives, antioxidants, corrosion prevention materials, and the like.

A grease composition provided in practice of this invention contains about 6 to 14% by weight of molybdenum disulfide particles smaller than about 325 mesh (44 microns). The molybdenum disulfide particles can be appreciably smaller (e.g. seven microns) since the lubricating effect appears to be independent of particle size and continues even when particle size is appreciably reduced during use of the grease. The composition also contains about 3 to 9% by weight of copper particles also smaller than about 325 mesh. The copper can be in the form of spheres, granules or leafing flake or can comprise composite granules also containing lead. In the latter form the copper is physically mixed with lead to form a two phase composite of pure copper as a continuous phase with pure lead distributed as a discontinuous phase in the copper. A suitable mix has a composition of about 60% copper and 40% lead by weight. This composite is considered to be copper in practice of this invention since it behaves like copper in a rock bit rather than like lead. Lead in rock bit grease tends to agglomerate and the lumps can damage the seal 33 leading to premature failure of a bearing.

When the grease composition is used in a rock bit, it appears that the copper is gradually comminuted and some of it may become bonded to the metal bearing surfaces. Such metal on the bearing surfaces could improve the fit of the bearings and tend to relieve high pressure regions which could lose lubrication. It has been observed that the original particles of copper have substantially entirely disappeared after about 70 to 100 hours of operation.

It appears that grease circulates between the region of the journal bearing and the grease reservoir, possibly due to intermittent changes in drilling pressure. It is observed that grease without copper particles of the original size appears in the reservoir from about 60 to 90 hours after drilling commences. Grease from the reservoir is believed to circulate to the bearings to replace the grease without copper particles. Such circulation could replenish copper depleted from the region of the bearings. This temporary presence of the copper powder is believed to provide protection for the molybdenum disulfide particles thereby prolonging the period that molybdenum disulfide can remain as a useful solid additive in the grease composition.

If the proportion of copper is less than about 3% by weight, insufficient copper can be present to protect the bearings or provide the prolonged life of molybdenum disulfide. If the molybdenum disulfide is present as less than about 6% by weight, the particles may be prematurely disintegrated and lose effectiveness in the grease composition.

When the proportions of copper powder and molybdenum disulfide powder are too high in the grease composition, the flow properties of the grease are adversely affected and the ability to lubricate, particularly at lower temperatures can be significantly degraded. Difficulties can also be encountered in introducing the grease into the rock bit after it is evacuated. Thus, if the copper powder is present in a proportion more than about 9% by weight, the proportion of molybdenum disulfide must be decreased to an extent that it may not be effective for the full lifetime of the rock bit. Similarly, if the proportion of molybdenum disulfide is more than about 14% by weight, the proportion of copper must be reduced and its protective effect diminished to the point that the total effective lifetime of the composition can be degraded.

Preferably, the copper powder is present in a proportion of about 5% by weight and the molybdenum disulfide powder is present in a proportion of about 11% by weight (plus or minus about 1% by weight). With these proportions of copper and molybdenum disulfide, the protective effect of the copper is maintained for a sufficient time to protect the molybdenum disulfide and maintain a long effective lifetime of the grease having these combined ingredients.

As in most greases, the principal portion of the composition is a refined petroleum or mineral oil which provides the basic lubricity. Thus, about ¾ by weight of the composition is such a mineral oil, preferably a paraffinic material for its good lubricity and resistance to elevated temperature decomposition. The grease provided in practice of this invention contains about 75% by weight of such a mineral oil. In an exemplary embodiment, it comprises a blend of about equal portions of an oil with a viscosity at 210° F. of about 500 Saybolt Universal Sectons (SUS) and an oil having a viscosity at 210° F. to about 80 to 85 SUS.

It is desirable to use both a high viscosity oil and a low viscosity oil in the grease. The copper powder is preferably mixed with a grease containing the high viscosity oil and then grease containing low viscosity oil is blended into the mixture. It is believed that the copper particles are preferentially wetted by the high viscosity oil and can be maintained in high pressure bearing regions where particularly needed. The low viscosity oil and molybdenum disulfide are believed useful for enhanced seal life.

One mode of lubrication failure first involves leakage of the seal and intrusion of drilling mud and the like into the grease system. The elastomeric O-ring slips relative to one or both of the steel surfaces of the bit body and cone as the cone rotates. If lubrication of the O-ring is deficient, high localized stretching of the O-ring can occur due to friction between the O-ring and steel. This can reduce the cross section of the O-ring and permit fluids to pass the seal. Any drilling mud entering the grease system is immiscible with the grease and can severely damage bearings. It is believed that the low viscosity oil is particularly useful in lubricating the seal area and that molybdenum disulfide particles may also assist in such lubrication. Less "orange peel" wear in the seal region has been observed in rock bits lubricated with grease as provided in practice of this invention than with other greases.

The grease composition includes a thickener for thickening the oil to an extent that it can readily retain the solid additives in suspension. Such a thickener is preferably a combination of two metal soaps or metal complex soaps wherein the metal is selected from the group consisting of aluminum, barium, calcium, lithium, sodium, and strontium. Such metal soaps are readily available and widely used in grease compositions. In particular, it is preferred that the metal soap comprise a combination of a lithium soap and either an aluminum complex soap or a calcium complex soap. Adverse side effects (such as, for example, gumminess from a barium soap) are avoided by such a combination.

Preferably the metal soaps are present in the range of from about 4 to 10% by weight. If the metal soaps are present in a proportion less than about 4% by weight, there can be insufficient thickening for maintaining the solid additive particles in suspension and distributing the particles adjacent the bearing surfaces. If the proportion of metal soaps is more than about 10% by weight, excessive stiffness of the grease can occur, particularly with a high viscosity oil base.

If desired, the composition can also include inert thickeners such as silica powder up to about 4% by weight. Such inert filler can help maintain active solid additives in suspension, particularly at elevated temperatures. If the proportion of silica is more than about 4% by weight, reductions in copper or molybdenum disulfide may be required to maintain a suitable consistency in the grease.

A variety of additional ingredients can be included in the grease composition; in particular it can be desirable to include extreme pressure additives, sometimes known as film strength additives. A variety of conventional extreme pressure agents which undergo chemical reaction with the metal surfaces and prevent metal to metal contact and scoring are well known in the art. Such agents are commonly compounds containing chlorine, phosphorous, and/or sulfur. Various chlorinated waxes, organic phosphites and phosphates, and sulfur containing unsaturated organic compounds are employed. Various organo-zinc and organo-lead compounds may also be employed.

Other ingredients included in the grease composition can include oxidation and corrosion inhibitors, dispersants and the like.

A particularly preferred grease composition for lubricating a rock bit comprises about 10.9% by weight molybdenum disulfide particles, about 5% by weight copper particles, about 2% by weight aluminum complex soap, about 4 to 5% by weight lithium soap, about 2% by weight silica powder, and a balance of primarily hydrocarbon oil. The grease can also include oxidation and corrosion inhibitors, extreme pressure agents and the like in effective amounts. The hydrocarbon oil is preferably a paraffinic material present as about ¾ of the composition, and can be a blend of an oil having a viscosity of about 80 to 85 SUS at 210° F., and an oil having a viscosity of about 500 SUS at 210° F. This composition has been shown to provide long life in a rock bit under severe operating conditions without gas generation or abnormal seal deterioration.

The expected service life of a rock bit varies appreciably depending on the formations being drilled and drilling parameters such as rotational speed and weight on the rock bit. Exemplary expected services are in the range of about 100 to 140 hours or about 500,000 to 600,000 revolutions of the bit which corresponds to about 700,000 to 850,000 revolutions of a cutter cone on a journal pin. Random premature failures of rock bits in as little as 20 to 60 hours sometimes occur and have been a problem in the field. Over 200 runs have been made with rock bits lubricated as provided in practice of this invention and not one premature bit failure that shows evidence of high pressure associated with failure of lubrication has been observed. Other premature failures have occurred and it cannot be determined if failure of lubrication was a factor.

An advantage of the grease composition is that a single grease can be used in a rock bit. Previously it has sometimes been the practice to apply a grease containing lead particles in the bearings upon assembly and fill the reservoir and passages with a non-leaded grease. The lead assists in initial operation of the bearing to accommodate small irregularities due to manufacturing tolerances. Such double greasing is costly and can be avoided with grease as provided in practice of this invention.

EXAMPLE I

A 460 pound drum of a grease suitable for lubricating rock bits can be formulated by the following procedure: 211 pounds of a grease identified as Sta-Lube No. 38995 is weighed into a clean drum; 24 pounds of −325 mesh leafing flake copper is added into the drum and blended with a stirrer at about 40 to 60 RPM until all the copper particles are wetted; 225.5 pounds of a grease identified as Chemola ST-3000 is added to the drum; mixing is then commenced at about 350 RPM and increased to about 900 RPM, the stirrer being raised and lowered and moved in a circular orbit in the drum for thorough mixing for at least one hour and fifteen minutes or until no color streaking or air blisters can be seen.

Sta-Lube 38995 is a grease obtained from Sta-Lube, Inc., Compton, California, comprising about 75% by weight of a refined paraffin oil having a viscosity of about 500 SUS at 210° F. About 4% by weight of an aluminum complex soap plus about 4% by weight of silica powder are included as thickeners. About 3 to 5.2% by weight of molybdenum disulfide powder having a particle size of about 7 microns is included in the composition along with extreme pressure additives, oxidation inhibitors and the like. Sta-Lube 38995 has a specific gravity of about 1.02, a worked penetration (ASTM D127) of about 35 to 390 millimeters, and a dropping point (ASTM D566) of about 400° F.

Chemola ST-3000 is a grease obtained from Chemola Division of Hi-Port Industries, Highlands, Texas. This grease comprises about 75% by weight of a refined paraffin oil having a viscosity of about 82.5 SUS at 210° F. About 8 to 10% by weight of lithium soap is employed as a thickener. Molybdenum disulfide having a particle size of about 7 microns is included as about 17 to 20% of the composition. Extreme pressure agents and antioxidants such as zinc dithiophosphate are included in the composition. This grease has a specific gravity of about 1.09, a worked penetration of about 280 millimeters, and a dropping point of about 350° F.

EXAMPLE II

Another grease composition incorporating copper and molybdenum disulfide particles is made by thoroughly mixing equal parts by weight of Chemola ST-3000 and CMI High Temperature grease. CMI High Temperature grease is obtained from Co-Mar Incorporated, Denver, Colorado, and comprises primarily a paraffin oil having a viscosity of about 450 to 650 SUS at 100° F. and 60 to 70 SUS at 210° F. The thickener is calcium complex soap sufficient to give a buttery texture and worked penetration (ASTM D127) of about 310 to 340 mm at 77° F. The CMI High Temperature grease used in this composition has about 12½% by weight of copper particles having a particle size of about 5 microns. The copper particles include a discontinuous phase of lead distributed in a continuous phase of copper. The copper comprises about 60% by weight of the particles and lead about 40%. Because of the difference in densities, the particles are about ⅜ by volume copper.

Rock bits have been lubricated with such grease by evacuating the bit and introducing the grease into the evacuated bit. No degradation of expected lifetime under the drilling conditions has been observed and premature failures of such bits have been reduced as compared with similar bits lubricated with prior grease compositions.

Sixty rock bits of 7⅞ inch diameter were greased with Chemola ST-3000 for field tests. Useful data from the field were obtained for thirty-six of these rock bits. These had a mean life of 529,900 revolutions of the bearings. The standard deviation of the reported tests was 45.7%. The longest completed run was 1,112,500 revolutions of the bearings.

Twenty similar rock bits were lubricated with two greases and field tested. The region of the bearings in each was packed with CMI High Temperature grease during assembly. The grease reservoir was filled with Chemola ST-3000 grease after assembly. The proportions of the two greases is not known with certainty. Useful field data were obtained from twelve of these rock bits. The mean life of these bits was 648,000 revolutions of the bearings with a standard deviation of 19.9%. The longest run was 899,100 revolutions of the bearings.

About 250 similar rock bits were lubricated with grease formulated in accordance with Example I and field tested. Useful field test data were obtained from 72 of these rock bits. These had a mean life of 715,600 revolutions of the bearings. The standard deviation was 27.0%. The longest reported run was 1,187,500 revolutions of the bearings.

Thirty similar rock bits were lubricated with grease formulated in accordance with Example II, and field tested. Useful data from the field were obtained for seventeen of these rock bits. These showed a mean life of 631,000+ revolutions of the bearings. The standard deviation of the reported tests was 47.4% and the longest run was 1,383,700 revolutions of the bearings.

Data from field testing of rock bits should be compared with appreciable caution and cannot be regarded as having mathematical precision. This is in part due to the almost uncontrolled variability inherent in field testing rock bits. Each rock bit is operated in an oil or gas well being drilled under field conditions and ordinarily within the sole control of the drill rig operator. A variety of rock formations can be encountered and the rock bits can be subjected to appreciable differences in the speed of rotation and weight on the rock bit. The effectiveness of drilling fluid in the hole can also vary.

Some field test data may also be rejected on a subjective basis. Some data may be rejected because of early bit failure due to factors totally unrelated to lubrication. Some data may be rejected because the rock bit is withdrawn from the drill hole before the end of its useful life. Rejection of field test data as a general rule tends to increase apparent mean lifetime and decrease standard deviation. The length of the longest reported run is unaffected. Numerical comparisons must be regarded with some caution.

The field test data considered to be significant and summarized above shows an increase in mean life of rock bits lubricated according to principles of this invention as compared with rock bits lubricated with Chemola ST-3000. The maximum length runs indicate that lubrication can be maintained much longer than the mean lifetime.

Although limited embodiments of this invention have been described in detail, many modifications and variations will be apparent to one skilled in the art. For example, many variations in the structure of the rock bit and materials of the journal bearings can be substituted. Such a grease is useful in rock bits with milled tooth cutters instead of tungsten carbide insert cutters or with roller bearings instead of journal bearings. It is therefore to be understood that within the scope of the appended claims the invention can be practiced otherwise than as specifically described.

What is claimed is:

1. A grease composition for lubricating a rock bit for drilling subterranean formations comprising:

copper particles in the range of from 3 to 9% by weight;

molybdenum disulfide particles in the range of from 6 to 14% by weight;

a metal soap wherein the metal is selected from the group consisting of aluminum, barium, calcium, lithium, sodium and strontium, and mixtures thereof; and a balance of primarily hydrocarbon oil.

2. A composition as recited in claim 1 wherein the molybdenum disulfide is present in a proportion of about 11% by weight.

3. A composition as recited in claim 2 wherein the copper is present in a proportion of about 5% by weight.

4. A composition as recited in claim 3 wherein the metal soap comprises a mixture of a lithium soap and a calcium complex soap or an aluminum complex soap, said mixture being present in the range of from about 4 to 10% by weight.

5. A composition as recited in claim 1 wherein the copper is present in a proportion of about 5% by weight.

6. A composition as recited in claim 5 wherein the metal soap comprises a mixture of lithium soap and a calcium complex soap or an aluminum complex soap, said mixture being present in the range of from about 4 to 10% by weight.

7. A composition as recited in claim 1 wherein the molybdenum disulfide is present in a proportion of about 11% by weight and the copper is present in a proportion of about 5% by weight.

8. A composition as recited in claim 1 wherein the metal soap comprises a mixture of two metal soaps and the metal is selected from the group consisting of aluminum, calcium, lithium, and sodium.

9. A composition as recited in claim 8 wherein the mixture of soaps comprises a lithium soap and a calcium complex soap or aluminum complex soap.

10. A composition as recited in claim 8 wherein the molydenum disulfide is present in a proportion of about 11% by weight.

11. A composition as recited in claim 10 wherein the copper is present in a proportion of about 5% by weight.

12. A composition as recited in claim 8 wherein the copper is present in a proportion of about 5% by weight.

13. A composition as recited in claim 8 wherein the metal soap is present in the range of from about 4 to 10% by weight.

14. A rock bit for drilling subterranean formations comprising a bit body including a plurality of journal pins each having a bearing surface;

a cutter cone mounted on each journal pin and including a bearing surface;

a pressure compensated grease reservoir in communication with such bearing surfaces; and a grease in the grease reservoir and adjacent the bearing surfaces comprising:

copper particles in the range of from 3 to 9% by weight;

molybdenum disulfide particles in the range of from 6 to 14% by weight;

a metal soap wherein the metal is selected from the group consisting of aluminum, barium, calcium, lithium, sodium, and strontium, and mixtures thereof; and a balance of primarily hydrocarbon oil.

15. A rock bit as recited in claim 14 wherein the molybdenum disulfide is present in a proportion of about 11% by weight.

16. A rock bit as recited in claim 15 wherein the copper is present in a proportion of about 5% by weight.

17. A rock bit as recited in claim 16 wherein the metal soap comprises a mixture of a lithium soap and a calcium complex soap or an aluminum complex soap, said mixture being present in the range of from about 4 to 10% by weight.

18. A rock bit as recited in claim 14 wherein the copper is present in a proportion of about 5% by weight.

19. A rock bit as recited in claim 18 wherein the metal soap comprises a mixture of lithium soap and a calcium complex soap or an aluminum complex soap, said mixture being present in the range of from about 4 to 10% by weight.

20. A rock bit as recited in claim 14 wherein the molybdenum disulfide is present in a proportion of about 11% by weight and the copper is present in a proportion of about 5% by weight.

21. A rock bit as recited in claim 14 wherein the metal soap comprises a mixture of two metal soaps and the metal is selected from the group consisting of aluminum, calcium, lithium, and sodium.

22. A rock bit as recited in claim 21 wherein the mixture of soaps comprises a lithium soap and a calcium complex soap or aluminum complex soap.

23. A rock bit as recited in claim 21 wherein the molybdenum disulfide is present in a proportion of about 11% by weight.

24. A rock bit as recited in claim 23 wherein the copper is present in a proportion of about 5% by weight.

25. A rock bit as recited in claim 14 wherein the copper is present in a proportion of about 5% by weight.

26. A rock bit as recited in claim 14 wherein the metal soap is present in the range of from about 4 to 10% by weight.

27. A method for lubricating a rock bit for drilling subterranean formations, the rock bit including a bit body and a plurality of cutter cones mounted on the bit body with journal bearings, comprising the steps of:

evacuating a portion of the rock bit body including the journal bearings; and introducing grease into the evacuated portion of the rock bit body and journal bearings, said grease comprising:

copper particles in the range of from 3 to 9% by weight;

molybdenum disulfide particles in the range of from 6 to 14% by weight;

a metal soap wherein the metal is selected from the group consisting of aluminum, barium, calcium, lithium, sodium and strontium, and mixtures thereof; and a balance of primarily hydrocarbon oil.

28. A method as recited in claim 27 wherein the molybdenum disulfide is present in a proportion of about 11% by weight.

29. A method as recited in claim 27 wherein the copper is present in a proportion of about 5% by weight.

30. A method as recited in claim 29 wherein the metal soap comprises a mixture of a lithium soap and a calcium complex soap or an aluminum complex soap, said mixture being present in the range of from about 4 to 10% by weight.

31. A method as recited in claim 27 wherein the copper is present in a proportion of about 5% by weight.

32. A method as recited in claim 31 wherein the metal soap comprises a mixture of lithium soap and a calcium complex soap or an aluminum complex soap, said mixture being present in the range of from about 4 to 10% by weight.

33. A method as recited in claim 27 wherein the molybdenum disulfide is present in a proportion of about 11% by weight and the copper is present in a proportion of about 5% by weight.

34. A method as recited in claim 27 wherein the metal soap comprises a mixture of two metal soaps and the metal is selected from the group consisting of aluminum, calcium, lithium, and sodium.

35. A method as recited in claim 34 wherein the mixture of soaps comprises a lithium soap and a calcium complex coap or aluminum complex soap.

36. A method as recited in claim 34 wherein the molybdenum disulfide is present in a proportion of about 11% by weight.

37. A method as recited in claim 36 wherein the copper is present in a proportion of about 5% by weight.

38. A method as recited in claim 27 wherein the copper is present in a proportion of about 5% by weight.

39. A method as recited in claim 27 wherein the metal soap is present in the range of from about 4 to 10% by weight.

40. A grease composition for lubricating a rock bit comprising about 11% by weight molybdenum disulfide particles, about 5% by weight copper particles, about 2% by weight aluminum complex soap, about 4 to 5% by weight lithium soap, about 2% by weight silica powder and a balance of primarily hydrocarbon oil.

* * * * *